US006955133B1

(12) United States Patent
Webster

(10) Patent No.: US 6,955,133 B1
(45) Date of Patent: Oct. 18, 2005

(54) SELF-DEPLOYING SAFETY BRACE SPRING

(75) Inventor: Elwood Ranck Webster, Camarillo, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 10 days.

(21) Appl. No.: 10/617,442

(22) Filed: Jul. 7, 2003

(51) Int. Cl.[7] ..... B63B 19/12
(52) U.S. Cl. ..... 114/201 R; 16/277; 49/386
(58) Field of Search ..... 114/201 R, 178; 49/379, 386; 16/277, 278, 298, 307, 308; 105/377.07

(56) References Cited

U.S. PATENT DOCUMENTS 938,593 A * 11/1909 Laubeuf ..... 114/178
1,823,790 A * 9/1931 Ducroux ..... 114/178
1,897,693 A * 2/1933 Ducroux ..... 114/178
2,812,522 A * 11/1957 Wilson ..... 4/241
3,461,607 A * 8/1969 Anderton et al. ..... 49/7
5,394,650 A * 3/1995 Dean ..... 49/386
5,465,862 A * 11/1995 Devlin ..... 220/830
5,683,139 A * 11/1997 Golynsky et al. ..... 297/302.3
6,185,302 B1 * 2/2001 Rytkonen et al. ..... 379/446
6,477,737 B2 * 11/2002 Migli ..... 16/335

* cited by examiner

*Primary Examiner*—Lars A. Olson
(74) *Attorney, Agent, or Firm*—Laura R. Foster

(57) ABSTRACT

The present invention relates to an apparatus to keep a safety brace in place on a cover, lid or door and a method of using the same. One aspect of the present invention includes an economical spring constructed to fit upon a safety brace in a way as to prevent the brace from being vibrated loose and allowing the cover, lid or door to close accidentally. Another aspect of the present invention is a method where the constructed spring is retrofitted upon an existing safety brace.

14 Claims, 5 Drawing Sheets

SELF-DEPLOYING SAFETY BRACE SPRING

CROSS-REFERENCE TO RELATED APPLICATION

This application is co-pending with a Utility Application, assigned Ser. No. 10/617,441, which was concurrently filed.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The present invention relates to safety braces for hinged items. In particular the present invention relates to an apparatus and a method to prevent the untimely closure of a hinged item including a scuttle lid.

BACKGROUND OF THE INVENTION

Many items are constructed with hinged members such as folding tables, doors, covers and lids. Many of these items are constructed to include some kind of safety feature, which will lock or prop the items in an open position so that they will not fold at an inopportune time and collapse.

A brace or prop safety feature is especially important in the case of horizontal doors, lids or covers. This is due to fact that these doors or covers can be weighty and are often used by persons for ingress and egress from an area or space. The safety features on these hinged items are important to prevent a weighty door or cover from closing on a person, thereby injuring them.

The brace or prop is mounted on the door or cover in such a way as to impede the motion of the door when the brace is engaged. But in situations when there is movement or vibration in the environment around the door or cover, a brace or prop can be shaken loose, thus allowing the door or cover to close and fall unexpectedly. This situation occurs frequently in the case of scuttle lids on board ships. Often the scuttle lid safety brace arrangement is susceptible to being shaken out of position by the movement of the ship or other vibrations. In addition, the safety brace may be accidentally bumped by personnel. Scuttle lids have been tied in place and pieces of wood have been placed between the scuttle lid hinges and the safety brace to prevent the lid from closing. Albeit inexpensive, these measures result in a substantial time delay in closing the lid when required and can pose a safety threat.

There are covers commercially available constructed with internal torsional springs or other means to prevent the safety braces from being shaken loose. But there currently exists an immense number of hinged cover, door or lid configurations, especially on board ships. It would be prohibitive to replace every one of these with newer, safer products, both from the standpoint of cost and time out of service.

Accordingly, there is a need for an economical and easy modification and retrofit of existing safety braces to prevent covers, doors or lids from being shaken loose, thereby preventing injuries from the hinged items closing on persons unexpectedly, especially on board ships.

Additional advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF SUMMARY OF THE INVENTION

The present invention relates to an apparatus to keep a safety brace in place on a cover, lid or door and a method of using the same. One aspect of the present invention includes an economical spring constructed to fit upon a safety brace in a way as to prevent the brace from being vibrated loose and allowing the cover, lid or door to close accidentally. Another aspect of the present invention is a method where the constructed spring is retrofitted upon an existing safety brace.

An embodiment of an aspect of the present invention is a biasing device for a scuttle lid safety brace assembly which comprises a spring mounted on the safety brace wherein the safety brace includes a plurality of linkages hingedly coupled to one another. The spring has a first, second and third section that are fixed to one another. The first section has an elongated first leg dimensioned and configured to exert a first force against the scuttle lid. The second section has a plurality of coils with each coil having an inside diameter dimensioned and configured to slidingly fit upon a hinge means operably coupling the safety brace to the scuttle lid. The coils are spaced apart and coupled by an intermediate member fixed to each of the coils and is dimensioned and configured to exert a second force against the safety brace linkages. The third section has an elongated second leg dimensioned and configured to exert a third force against the scuttle lid. The legs and the intermediate member apply each force to rotatively bias the linkages of the safety brace against the scuttle lid, forcing the safety brace to remain folded in the direction, preventing the scuttle lid from closing.

Another embodiment of an aspect of the present invention is a biasing device for a scuttle lid safety brace assembly which comprises a spring mounted on the safety brace wherein the safety brace includes a plurality of linkages hingedly coupled to one another. The spring has a first, second and third section that are fixed to one another. The first section has an elongated first leg dimensioned and configured to exert a first force against the scuttle lid. The second section has a plurality of coils with each coil having an inside diameter dimensioned and configured to slidingly fit upon a hinge means operably coupling the safety brace to the scuttle lid. The third section has an elongated second leg dimensioned and configured to exert a second force against the linkages of the safety brace. The legs apply each force to rotatively bias the linkages of the safety brace against said scuttle lid, forcing the safety brace to remain folded in the direction, preventing the scuttle lid from closing.

It has been found desirable to comprise the spring of a unitary structure of about 0.09 inch diameter 304 stainless steel. In particular, the second force is about 40 inch-pounds, with a static angle of about 145 degrees.

Another aspect of the present invention includes a method for rotatively biasing a safety brace on a scuttle lid thereby preventing the lid from closing including: providing a scuttle lid having a safety brace attached by a hinge pin and providing a biasing device including: a spring mounted on the safety brace having a first, second and third sections that are fixed to one another, the first section having an elongated first leg dimensioned and configured to exert a first force against the scuttle lid, the second section which has a plurality of coils each having an inside diameter dimensioned and configured to slidingly fit upon the hinge means that is operably coupling the safety brace to the scuttle lid, each coil spaced apart and coupled by an intermediate member dimensioned and configured to exert a second force against the safety brace, the third section having an elongated second leg also dimensioned and configured to exert a third force against the scuttle lid, rotatively biasing the safety brace linkages relative to the scuttle lid in that the safety brace is biased to remain folded in the direction preventing the scuttle lid from closing. Subsequently, removing the hinge pin and replacing it with a hinging means, including a bolt, dimensioned and configured to slide within the coils of the spring and at the same time coupling the safety brace to the scuttle lid. The spring is secured to the hinge means by washers and a fastener including a nut or a cotter pin. The spring is positioned so that it rotatively biases the safety brace so that it cannot unfold away from the scuttle lid, thereby preventing the lid from closing until operated by personnel.

Another embodiment of this aspect of the present invention includes a method for rotatively biasing a safety brace on a scuttle lid thereby preventing the lid from closing including: providing a scuttle lid having a safety brace attached by a hinge pin and providing a biasing device including: a spring mounted on the safety brace having a first, second and third sections that are fixed to one another, the first section having an elongated first leg dimensioned and configured to exert a first force against the scuttle lid, the second section which has at least one coil having an inside diameter dimensioned and configured to slidingly fit upon the hinge means that is operably coupling the safety brace to the scuttle lid, the third section having an elongated second leg also dimensioned and configured to exert a second force against the safety brace linkages, rotatively biasing the safety brace linkages relative to the scuttle lid in that the safety brace is biased to remain folded in the direction preventing the scuttle lid from closing. Subsequently, removing the hinge pin and replacing it with a hinging means, including a bolt, dimensioned and configured to slide within the coils of the spring and at the same time coupling the safety brace to the scuttle lid. The spring is secured to the hinge means by washers and a fastener including a nut or a cotter pin. The spring is positioned so that it rotatively biases the safety brace so that it cannot unfold away from the scuttle lid, thereby preventing the lid from closing until operated by personnel.

The device and method of the present invention is of simple construction and implementation, with the ability to be easily retrofitted entirely externally without requiring welding or other labor intensive installation by personnel, and without a significant out of service time.

Still other advantages of the present invention will become readily apparent to those skilled in this art from the following detailed description. As will be realized, the invention is capable of other and different embodiments, and its several details are capable of modifications in various obvious respects, all without departing from the invention. Accordingly, the drawings and description are to be regarded as illustrative in nature, and not as restrictive.

DETAILED DESCRIPTION OF THE EMBODIMENTS OF THE INVENTION

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

The present invention relates to an apparatus to keep a safety brace in place on a cover, lid or door and a method of using the same. One aspect of the present invention includes an economical spring constructed to fit upon a safety brace in a way as to prevent the brace from being vibrated loose and allowing the cover, lid or door to close accidentally. Another aspect of the present invention is a method where the constructed spring is retrofitted upon an existing safety brace.

Figure 1:
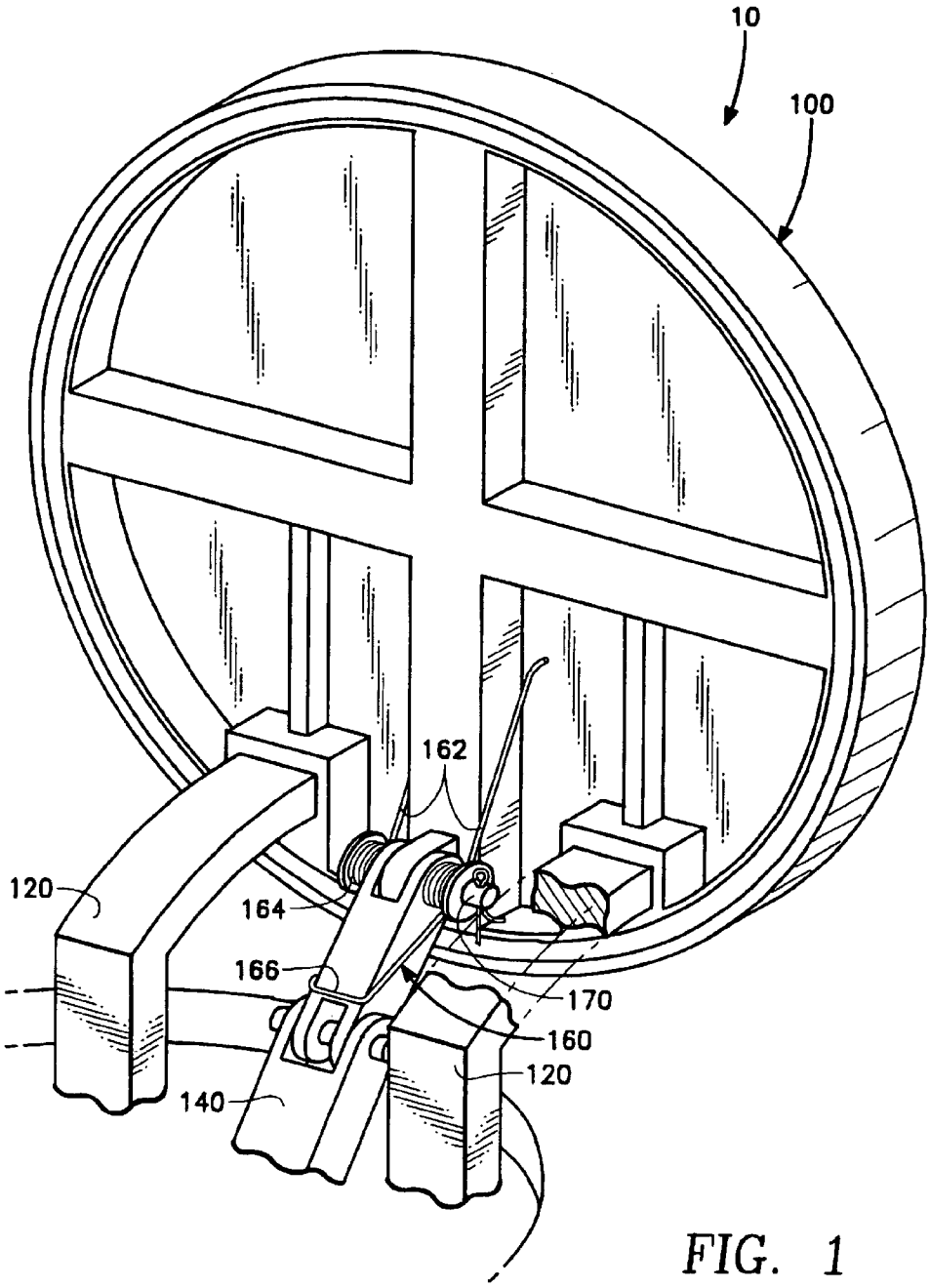
FIG. 1 is a perspective view of an embodiment of the present invention showing an installed spring in a scuttle lid assembly.

Referring to the drawings, wherein like reference numerals represent like parts throughout, referring to FIG. 1, reference numeral 10 is directed to one aspect of the present invention which includes a scuttle lid assembly having a safety brace 140. The scuttle lid assembly 10 includes a scuttle lid 100, the lid hinges 120 and a hinged safety brace 140. The safety brace 140 is constructed of a pair of linkages. The linkages are hingedly coupled so that the safety brace 140 folds only partially in the direction of the scuttle lid 100. When the safety brace 140 is folded inwardly toward the scuttle lid 100 (the position shown in FIG. 1) the inability of the linkages to fold any farther inward prevents the closing of the scuttle lid 100, in the absence of vibration or jostling.

Mounted on the safety brace 140 and the scuttle lid 100 is an aspect of the present invention, a torsional spring 160. The spring 160 includes elongated legs 162 each extending from one end of the coils 164 of the spring 160 that exert first and third forces against the scuttle lid 100. The coils 160 are spaced apart and coupled by an intermediate member 166. The intermediate member 166 being dimensioned so as to fit around and exert a second force against the safety brace 140. This force rotatively biases the safety brace 140 toward the scuttle lid so that the safety brace 140 is prevented from unfolding away from the scuttle lid 100 and allowing the scuttle lid 100 to close. The spring 160 being constructed in that the forces are sufficient to prevent the safety brace 140 from inadvertently unfolding but not so much as to prevent a person from overcoming the force and closing the lid as desired.

Figure 2:
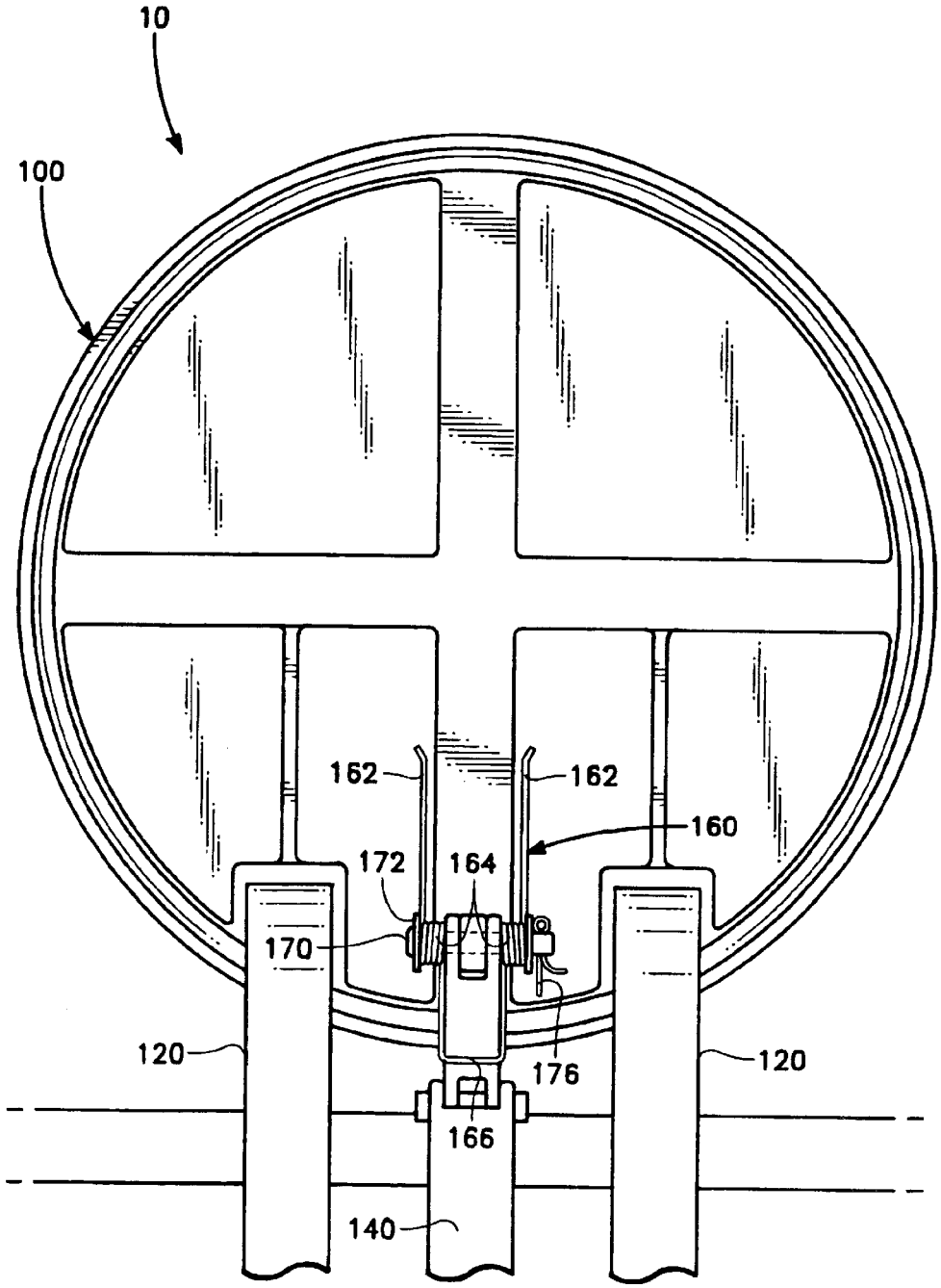
FIG. 2 is a front view of an embodiment of the present invention showing an installed spring in a scuttle lid assembly.

Referring to FIG. 2, the spring 160 of an embodiment of the present invention, elongated legs 162, coils 164 and intermediate member 166 is shown in a front view. The spring coils 164 slidingly fit upon the bolt 170 coupling the safety brace 140 to the scuttle lid 100 and in another embodiment of the present invention is secured by washers 172 and a cotter pin 176. (Alternate ways to secure the spring in place on the bolt are also used, including a nut, in lieu of the cotter pin.) The spring will be easily retrofitted to existing scuttle lids by ship's personnel while underway, thereby eliminating the need to replace the scuttle lid assembly for safety reasons prior to the end of its useful life. It is noteworthy that the dimensions and material of the spring of the present invention are changed in order to exert sufficient force on the safety braces for lids of various sizes.

Figure 3:
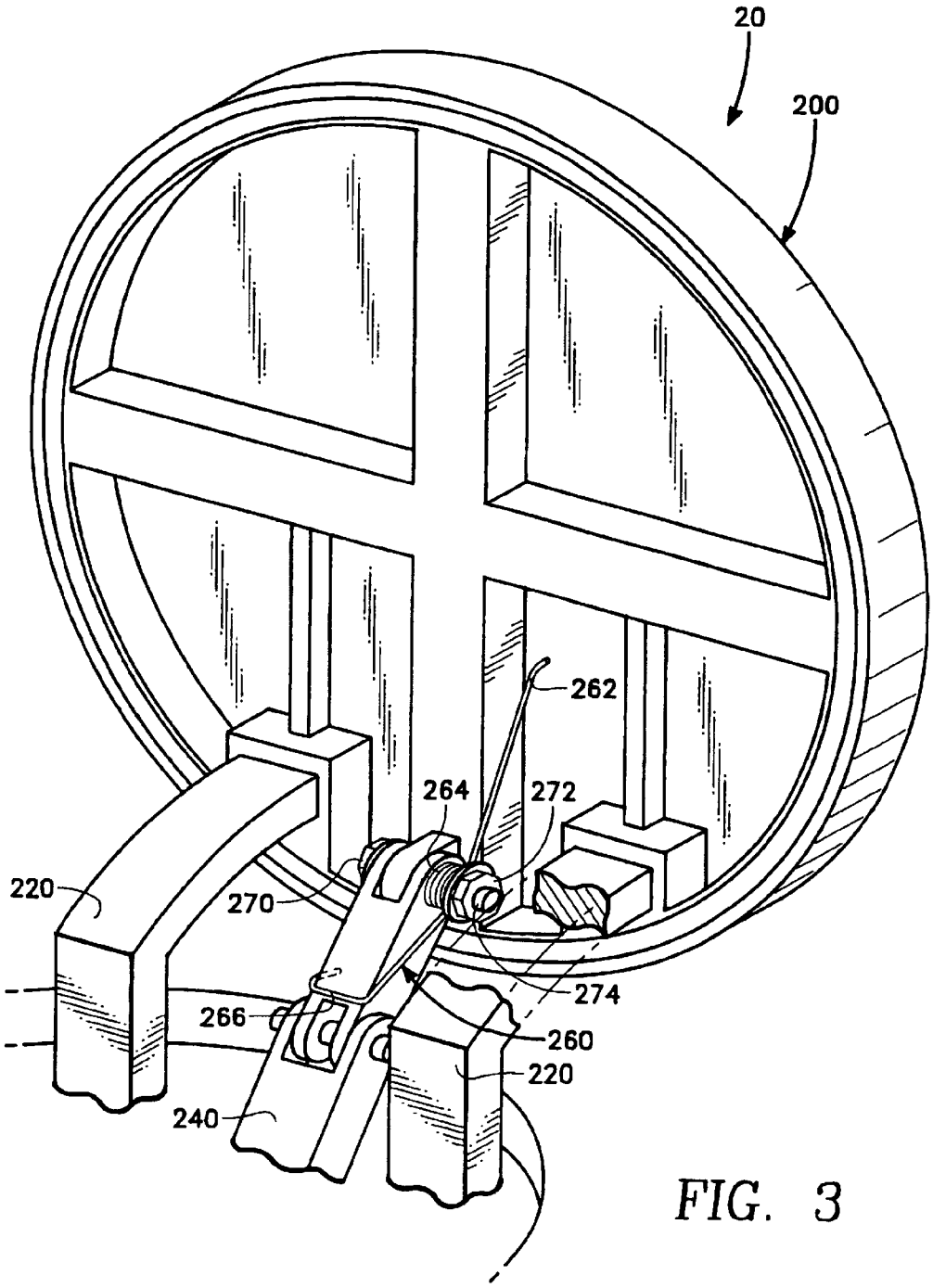
FIG. 3 is a perspective view of another embodiment of the present invention showing an installed spring in a scuttle lid assembly.

Referring to FIG. 3, a perspective view of another embodiment of the present invention, reference numeral 20 is directed to a scuttle lid assembly including a safety brace. The scuttle lid assembly 20 includes a scuttle lid 200, the lid hinges 220 and a hinged safety brace 240. Mounted on the safety brace 240 and the scuttle lid 200 is a torsional spring 260 of another embodiment of the present invention. The spring coil 264 slidingly fits upon the bolt 270 coupling the safety brace 240 to the scuttle lid 200 and in another embodiment of the present invention is secured by washers 272 and a nut 274. The spring 260 includes an elongated leg 262 extending from one end of the coil 264 of the spring 260 that exerts a first force against the scuttle lid 200. The spring includes a second elongated leg 266 dimensioned so as to fit around and exert a second force against the safety brace linkages. This force rotatively biases the safety brace 240 toward the scuttle lid 200 so that the safety brace 240 is prevented from unfolding away from the scuttle lid 200 and allowing the scuttle lid 200 to close. The spring 260 being constructed in that the force is sufficient to prevent the safety brace 240 from inadvertently unfolding but not so much as to prevent a person from overcoming the force and closing the lid as desired. The spring 260 of this embodiment is economical, utilizing less material and manufacturing time.

Figure 4:
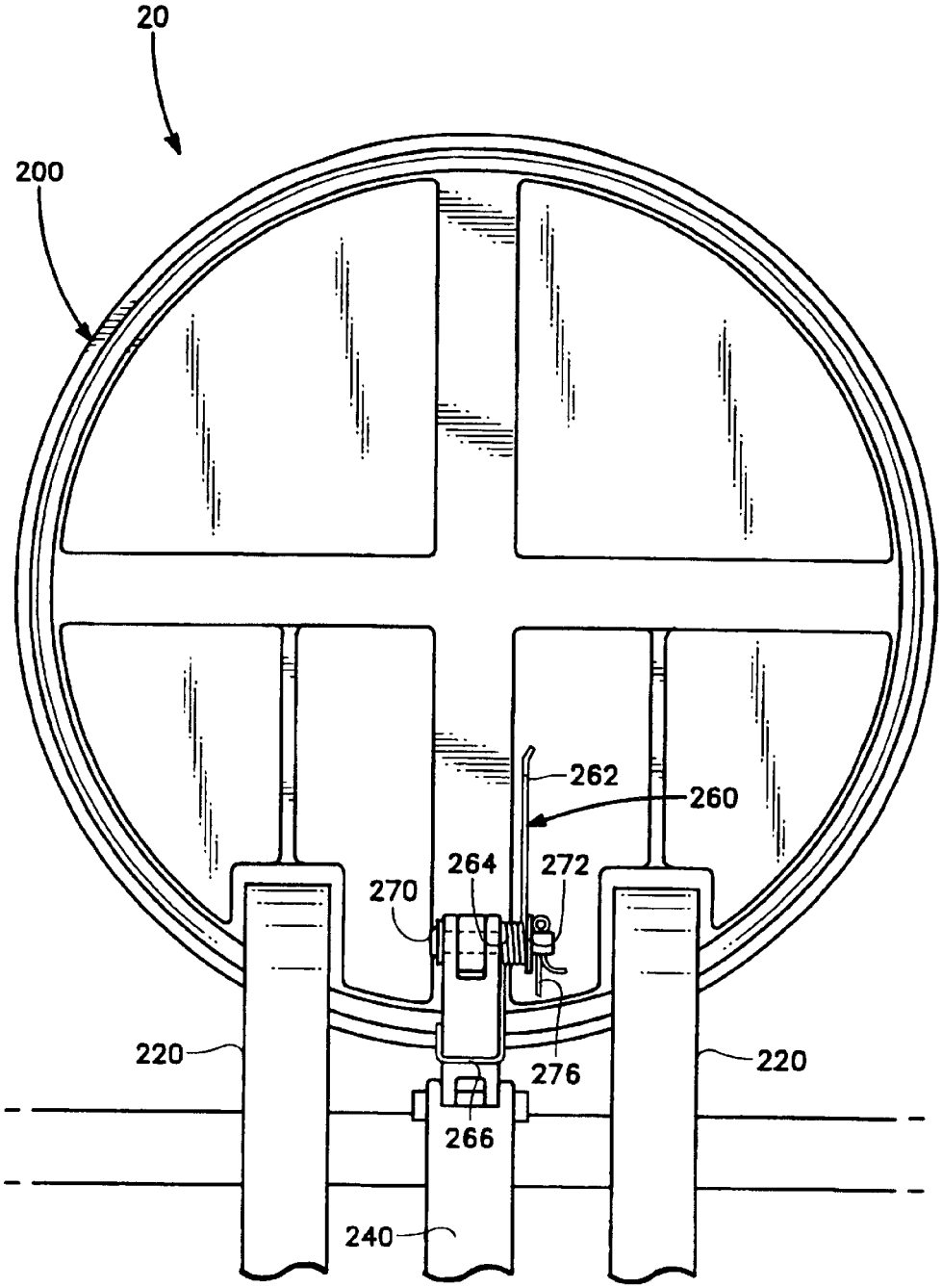
FIG. 4 is a front view of another embodiment of the present invention showing an installed spring in a scuttle lid assembly.

Referring to FIG. 4, a front view of another embodiment of the present invention, reference numeral 20 is directed to a scuttle lid assembly including a safety brace. The scuttle lid assembly 20 includes a scuttle lid 200, the lid hinges 220, a hinged safety brace 240, a spring 260, elongated leg 262, and a second elongated leg 266 as previously described in FIG. 3. The spring coil 264 slidingly fits upon the bolt 270 coupling the safety brace 240 to the scuttle lid 200 and in another embodiment of the present invention is secured by washers 272 and a cotter pin 276.

Figure 5:
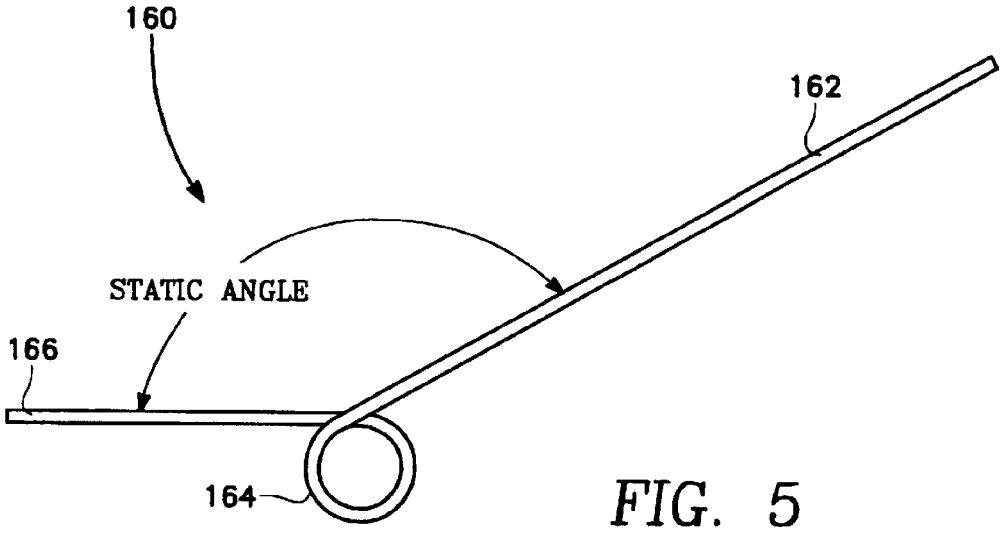
FIG. 5 is a side view illustrating an example of one embodiment of the present invention showing the static angle of the spring.

FIG. 5 illustrates an example of an embodiment of the present invention including a spring 160 constructed to have a static angle of about 145 degrees between the elongated legs 162 and the intermediate member 166 after forming, winding and normalization is complete. The spring 160 is installed on the safety brace 140 as shown in FIGS. 1 and 2 so that the spring coils 164 are positioned on either side of the safety brace 140 and on a hinge bolt 170 or pin of sufficient length to accommodate the coils and secured in place by washers 172 and a nut or cotter pin 176. For example, a spring formed of about 0.09 inch diameter, 304 stainless steel wire which is normalized after forming, installed on a safety brace that is propping open an about 21 inch diameter horizontally mounted scuttle lid weighing about 90 pounds. In the example, the spring exerts a force of about 40 inch-pounds, rotatively biasing the safety brace in such a way that the safety brace cannot fold away from the scuttle lid without intervention by personnel. Other examples include the spring being easily retrofitted on scuttle lids by personnel while a ship is on normal operations.

Another aspect of the present invention includes a method for rotatively biasing a safety brace on a scuttle lid thereby preventing the lid from closing including: providing a scuttle lid having a safety brace attached by a hinge pin and providing a biasing device including: a spring mounted on the safety brace having a first, second and third sections that are fixed to one another, the first section having an elongated first leg dimensioned and configured to exert a first force against the scuttle lid, the second section which has a plurality of coils each having an inside diameter dimensioned and configured to slidingly fit upon the hinge means that is operably coupling the safety brace to the scuttle lid, each coil spaced apart and coupled by an intermediate member dimensioned and configured to exert a second force against the safety brace, the third section having an elongated second leg also dimensioned and configured to exert a third force against the scuttle lid, rotatively biasing the safety brace linkages relative to the scuttle lid in that the safety brace is biased to remain folded in the direction preventing the scuttle lid from closing. Subsequently, removing the hinge pin and replacing it with a hinging means, including a bolt, dimensioned and configured to slide within the coils of the spring and at the same time coupling the safety brace to the scuttle lid. The spring is secured to the hinge means by washers and a fastener including a nut or a cotter pin. The spring is positioned so that it rotatively biases the safety brace so that it cannot unfold away from the scuttle lid, thereby preventing the lid from closing until operated by personnel.

Another embodiment of this aspect of the present invention includes a method for rotatively biasing a safety brace on a scuttle lid thereby preventing the lid from closing including: providing a scuttle lid having a safety brace attached by a hinge pin and providing a biasing device including: a spring mounted on the safety brace having a first, second and third sections that are fixed to one another, the first section having an elongated first leg dimensioned and configured to exert a first force against the scuttle lid, the second section which has at least one coil having an inside diameter dimensioned and configured to slidingly fit upon the hinge means that is operably coupling the safety brace to the scuttle lid, the third section having an elongated second leg also dimensioned and configured to exert a second force against the safety brace linkages, rotatively biasing the safety brace linkages relative to the scuttle lid in that the safety brace is biased to remain folded in the direction preventing the scuttle lid from closing. Subsequently, removing the hinge pin and replacing it with a hinging means, including a bolt, dimensioned and configured to slide within the coils of the spring and at the same time coupling the safety brace to the scuttle lid. The spring is secured to the hinge means by washers and a fastener including a nut or a cotter pin. The spring is positioned so that it rotatively biases the safety brace so that it cannot unfold away from the scuttle lid, thereby preventing the lid from closing until operated by personnel.

Although the description above contains much specificity, this should not be construed as limiting the scope of the invention but as merely providing an illustration of the presently preferred embodiment of the invention. Thus the scope of this invention should be determined by the appended claims and their legal equivalents.

What is claimed is:

1. A biasing device for a scuttle lid safety brace assembly comprising:

a spring mounted on the safety brace;

said safety brace comprising a plurality of linkages hingedly coupled to one another;

said spring having a first section, a second section and a third section;

said first section having an elongated first leg, said first leg dimensioned and configured to exert a first force against said scuttle lid;

said first section fixed to said second section, said second section having a plurality of coil(s), each said coil having an inside diameter dimensioned and configured to slidingly fit upon a hinge means operably coupling said safety brace to said scuttle lid;

said coil(s) spaced apart and coupled by an intermediate member fixed to each said coil(s) and dimensioned and configured to exert a second force against said safety brace linkage(s);

said second section fixed to said third section, said third section having an elongated second leg, said second leg dimensioned and configured to exert a third force against said scuttle lid; and said legs and said intermediate member applying each said force to rotatively bias said linkage(s) of said safety brace against said scuttle lid, wherein said linkage(s) are biased to remain folded in the direction preventing said scuttle lid from closing.

2. The device of claim 1, wherein said spring comprises a unitary structure.

3. The device of claim 1, wherein said coil being formed of a wire of about 0.09 inch diameter 304 stainless steel.

4. The device of claim 1, wherein said second force being about 40 inch-pounds.

5. The device of claim 1, wherein said spring includes a torsion spring.

6. The device of claim 1, wherein said first leg being positioned at a static angle relative to said intermediate member.

7. The device of claim 6, wherein said static angle being about 145 degrees.

8. A method for rotatively biasing a safety brace on a scuttle lid thereby preventing the lid from closing comprising:

providing said scuttle lid having said safety brace operably coupled by a hinge pin;

providing a biasing device comprising:

a spring mounted on said safety brace;

said safety brace comprising a plurality of linkages hingedly coupled to one another;

said spring having a first section, a second section and a third section;

said first section having an elongated first leg, said first leg dimensioned and configured to exert a first force against said scuttle lid;

said first section fixed to said second section, said second section having a plurality of coils, each said coil(s) having an inside diameter dimensioned and configured to slidingly fit upon a hinge means operably coupling said safety brace to said scuttle lid;

said coil(s) spaced apart and coupled by an intermediate member fixed to each said coil(s) and dimensioned and configured to exert a second force against said safety brace linkage(s);

said second section fixed to said third section, said third section having an elongated second leg, said second leg dimensioned and configured to exert a third force against said scuttle lid;

said legs and said intermediate member applying each said force to rotatively bias said linkage(s) of said safety brace relative to said scuttle lid, whereby said linkage(s) are biased to remain folded in the direction preventing said scuttle lid from closing;

removing said hinge pin coupling said safety brace to said scuttle lid;

providing a hinging means dimensioned and configured to slide within said coils of said spring dimensioned and configured to rotatively bias said safety brace against said scuttle lid;

replacing said hinge pin with said hinging means; and positioning said hinging means within said coil(s) in that said spring is operably coupled to said brace and said scuttle lid to prevent said lid from closing.

9. The device of claim 8, wherein said spring comprises a unitary structure.

10. The device of claim 8, wherein said coil being formed of a wire of about 0.09 inch diameter 304 stainless steel.

11. The device of claim 8, wherein said second force being about 40 inch-pounds.

12. The device of claim 8, wherein said spring includes a torsion spring.

13. The device of claim 8, wherein said first leg being positioned at a static angle relative to said intermediate member.

14. The device of claim 13, wherein said static angle being about 145 degrees.

* * * * *